United States Patent [19]

Anderson

[11] 4,142,726

[45] Mar. 6, 1979

[54] FRAMED PICTURE PUZZLE

[76] Inventor: John S. Anderson, Manor Hill Farm, Glenarm, Md. 21057

[21] Appl. No.: 811,864

[22] Filed: Jun. 30, 1977

[51] Int. Cl.[2] ..... A63F 9/10

[52] U.S. Cl. ..... 273/157 R; 40/156

[58] Field of Search ..... 273/157 R, 155; 40/152.1, 156

[56] References Cited

U.S. PATENT DOCUMENTS

| | | | |
|---|---|---|---|
| 904,387 | 11/1908 | Welsh | 273/155 UX |
| 2,496,884 | 2/1950 | Miles | 40/156 X |
| 2,758,402 | 8/1956 | Fulmer | 40/152.1 |
| 3,137,967 | 6/1964 | Flieth | 273/157 R X |
| 3,741,548 | 6/1973 | Kaupp | 273/157 R |
| 3,964,750 | 6/1976 | Brown | 273/157 R |

FOREIGN PATENT DOCUMENTS

| | | | |
|---|---|---|---|
| 278072 | 9/1927 | United Kingdom | 273/155 |
| 434491 | 8/1935 | United Kingdom | 273/157 R |

*Primary Examiner*—Anton O. Oechsle

*Attorney, Agent, or Firm*—Laurence R. Brown

[57] ABSTRACT

A jigsaw type puzzle is held in a frame formed of three laminations held together and comprising a picture border, an intermediate spacer and a backing plate. An aperture defined in the intermediate spacer receives the assembled picture puzzle with edges thereof under a ledge defined by a smaller picture viewing aperture in the border lamination. To permit assembly in place on the frame for viewing, storing and hanging, the puzzle pieces are resilient so they can be bent for insertion of the edges under the ledge, and in one form comprise strips extending across one dimension of the picture viewing aperture, which may be bowed in the middle.

7 Claims, 3 Drawing Figures

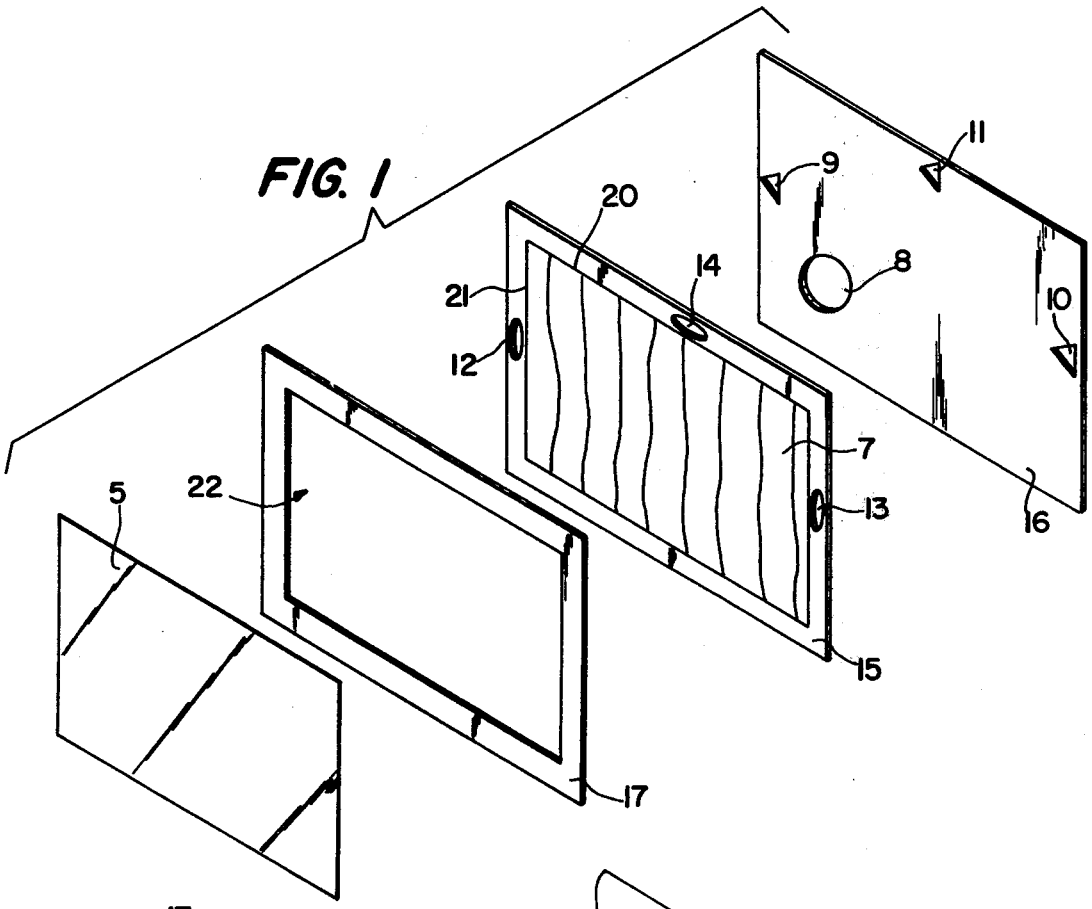
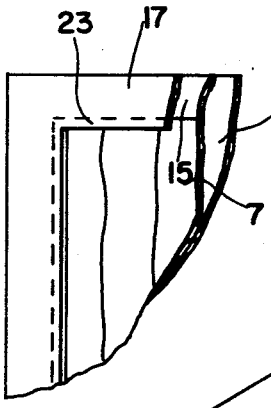
FIG. 3
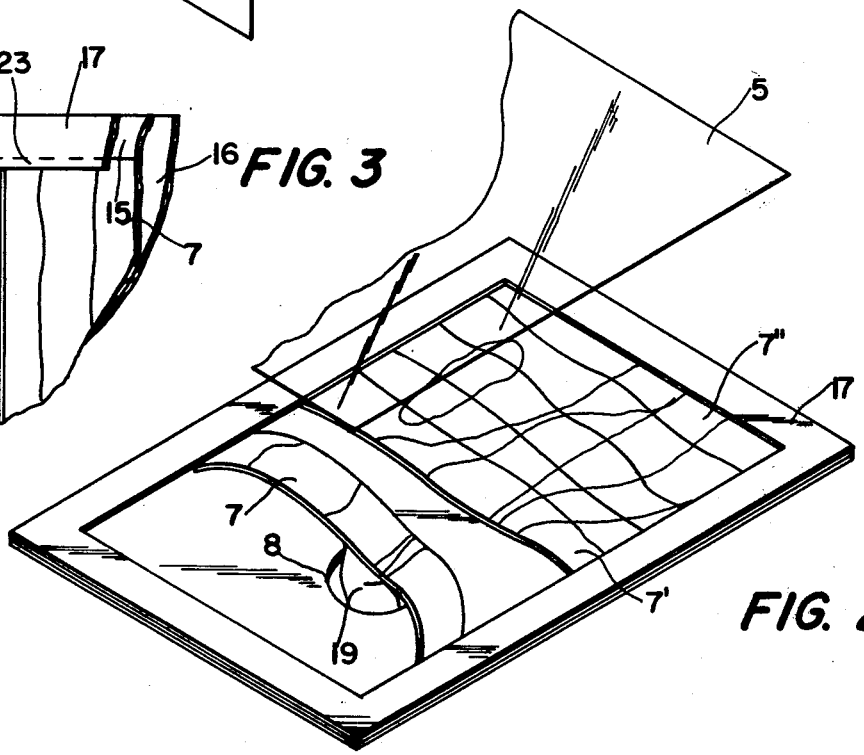
FIG. 2

FRAMED PICTURE PUZZLE

This invention relates to framed pictures, and more particularly it relates to jigsaw type puzzles forming pictures which are held in a frame and hung for viewing.

BACKGROUND OF THE INVENTION

It has heretofore been proposed, for example in U.S. Pat. Nos. 1,415,245 and 1,789,782 and 3,606,338, that jigsaw type picture puzzles can be viewed in assembled form in frames or windowed boxes. However, the picture must be fully assembled first and thereafter secured by covering with edge strips and glass to seal it in place. The picture then may be hung for viewing.

However, the puzzle when assembled in the frame to be hung as a picture is only worked once and is not ordinarily adapted to be worked over and over at will without disassembly of the frame.

Furthermore, the picture cannot readily be changed in the frame without disassembly.

OBJECTS OF THE INVENTION

It is therefore a general object of the invention to provide improved picture puzzles for hanging in picture frames for viewing.

Another object of the invention is to provide frames for picture puzzles wherein the pictures may be changed readily.

A still further object of the invention is to provide a picture puzzle and assembled storage frame therefor in which the puzzle may be worked, reworked, stored, hung and viewed.

BRIEF DESCRIPTION OF THE INVENTION

An assembled frame defines a ledge for receiving edges of jigsaw-type picture puzzle pieces for interlocking therein so that the puzzle may be hung for viewing and disassembled and reworked from time to time as desired. The picture puzzle may have different pictures front and back to change scenes and moods of the picture.

THE DRAWING

Other features, objectives and advantages of the invention will be found throughout the following specification and accompanying drawings, wherein:

FIG. 1 is an exploded view of the several laminations making up the picture puzzle, FIG. 2 is a perspective top view of a partially assembled picture puzzle having a strip puzzle piece bowed for removal or insertion into registry with frame interlock ledges, and FIG. 3 is a fragmentary assembled picture frame view in perspective showing the interlocking ledge which receives and retains picture puzzle pieces.

DETAILED DESCRIPTION OF THE INVENTION

As may be seen in the drawing, a set of four laminations, one an optional transparent cover sheet 5, is stacked and glued or otherwise fixed together at the outer edges to form a stack as shown in FIGS. 2 and 3.

The rearmost lamination 16 comprises a backing member upon which the puzzle pieces 7, 7', etc. rest, when assembled. Of the four functional apertures 8–11 through the backing plate or members 16, three, namely 9–11 serve as hanger means, each registering with respective larger interior apertures 12–14 in intermediate spacing lamination 15. Thus, a hook or string catch member (not shown) may be inserted through aperture 11 and into aperture 14 for hanging on one hook, alternatively a string or wire may be held between two similar catches inserted from the back into aperture pairs 9, 12 and 10, 13. The remaining aperture 8, as shown better in FIG. 2, is for the purpose of inserting a finger 19 to bow a strip puzzle piece 7, thereby to remove it from the frame when assembled to facilitate taking out a picture puzzle to rework or replace with a new picture puzzle. For example, different pictures may be superimposed on opposite sides of the puzzle pieces, so that by change of mood or season the framed picture may be taken down, disassembled, reworked and hung as a different picture.

The intermediate lamination 15 may simply comprise a die cut cardboard sheet with apertures 12–14 cut through and picture puzzle pieces 7 almost cut through so they can be easily manually broken away into discrete puzzle pieces. Preferably the three laminations 15–17 are of the same thickness die cut cardboard, which are then glued together about the outer edges to form a laminated picture-frame assembly.

The picture puzzle has an outer dimension about the edges 20, 21 that is slightly larger than the viewing aperture 22 inside the border member 17. This is a critical feature of the invention in that it defines a ledge 23 under which the edges of the puzzle pieces may be inserted, as for example shown by the bowing of piece 7 in FIG. 2. Preferably therefore the puzzle pieces constitute strips 7 as shown where opposite ends are registered under the ledge 23 and retained in place in the frame. However, interlocking puzzle pieces may also be used where only the edge members need be confined to hold the puzzle picture in assembled form.

The border member 17, if cardboard, can be slightly manually deformed for entry of the edges of puzzle pieces 7, even if the picture puzzle piece 7 thickness is identical with that of the depth of ledge 23 as defined by the thickness of intermediate lamination member 15. If some play were desired, a further spacer member could be used about the border of intermediate lamination 15. This also is necessary if the protective transparent front lamination 5 is thick. However, preferably this is a thin, although thick enough to be handled without crumpling, sheet of cellophane, celluloid or the like protective cover having enough resilience so that it may be inserted under ledge 23 after the picture is fully assembled in place in the frame, and thus serve as a protective dust cover. The outer dimensions of cover lamination 5 therefore substantially coincide with those of picture borders 20, 21.

It is to be recognized that various puzzle shapes can be used with different aspect ratios and borders. The essential feature of this invention is an interlocking member 23 in the frame which holds removably in place pieces of an assembled picture puzzle so that an assembled puzzle may be stored, and hung, in assembled form as a framed picture, and thereafter may be disassembled and reworked at will.

Accordingly, those novel features definitive of the spirit and nature of the invention are set forth with particularity in the appended claims.

What is claimed is:

1. A jigsaw type picture puzzle and retainer frame combination permitting the picture puzzle to be stored in the frame and viewed therein in assembled form, comprising, a set of picture puzzle pieces of predetermined thickness that in assembly together form a picture of predetermined outer dimensions and thickness, said retainer frame comprising three laminated layers, namely a backing member, an intermediate spacing member substantially the thickness of said puzzle pieces, and an upper member comprising a border member, said spacing member defining an aperture larger than said viewing aperture to thereby form a ledge between the border member and backing member, the border member being affixed in place to the frame and defining a picture viewing aperture of smaller dimensions than that of the assembled picture with the ledge thereunder substantially registering with said assembled picture dimensions, the backing member being affixed in said frame, the ledge having a depth to said backing member substantially registering with the picture puzzle pieces thickness, at least those of the puzzle pieces that fit around the outer edge of the picture having a resiliency and shape that permit bending for fitting into and removing from under the ledge so that the picture may be assembled and disassembled into the retainer frame.

2. The combination defined in claim 1, wherein the laminated layers are cardboard affixed together by glue.

3. The combination defined in claim 1, wherein the layers all comprise panels of substantially the same outer dimension and thickness, and the intermediate spacing member and border member are die cut before lamination to form therefrom the apertures, and the picture pieces.

4. The combination defined in claim 1, including an aperture formed through the backing member accessible from the back of the frame and registered with one of said resilient puzzle pieces to manually dislodge it from a position with edges thereof under said border in registration with said ledge.

5. The combination defined in claim 1, including at least one picture hanging aperture defined in appropriate position through the backing member, and a registered larger aperture defined through the intermediate spacing member thereby to receive a hanger member.

6. The combination defined in claim 1, wherein the puzzle pieces have pictures on both sides thereof.

7. The combination defined in claim 1, wherein all the puzzle pieces comprise strips that extend across the viewing aperture and under two opposed ledge positions on opposite ends of the strips.

* * * * *